US009993822B2

(12) United States Patent
Sugiyama et al.

(10) Patent No.: US 9,993,822 B2
(45) Date of Patent: Jun. 12, 2018

(54) NUCLEIC ACID AMPLIFICATION/DETECTION DEVICE AND NUCLEIC ACID INSPECTION DEVICE USING SAME

(71) Applicant: HITACHI HIGH-TECHNOLOGIES CORPORATION, Tokyo (JP)

(72) Inventors: Kimikazu Sugiyama, Tokyo (JP); Minoru Sano, Tokyo (JP); Yasunori Shoji, Tokyo (JP); Yoshiyuki Shoji, Tokyo (JP); Yuki Kikuchi, Tokyo (JP); Manami Nammoku, Tokyo (JP); Ryoji Inaba, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 102 days.

(21) Appl. No.: 14/898,286

(22) PCT Filed: Jun. 18, 2014

(86) PCT No.: PCT/JP2014/066089
§ 371 (c)(1),
(2) Date: Dec. 14, 2015

(87) PCT Pub. No.: WO2015/005078
PCT Pub. Date: Jan. 15, 2015

(65) Prior Publication Data

US 2016/0144366 A1 May 26, 2016

(30) Foreign Application Priority Data

Jul. 8, 2013 (JP) ..... 2013-142229

(51) Int. Cl.
*B01L 7/00* (2006.01)

(52) U.S. Cl.
CPC ..... *B01L 7/52* (2013.01); *B01L 2300/046* (2013.01); *B01L 2300/0609* (2013.01);
(Continued)

(58) Field of Classification Search
CPC ..... B01L 7/52; B01L 2300/0803; B01L 2300/1822; B01L 2300/1883;
(Continued)

(56) References Cited

U.S. PATENT DOCUMENTS

2009/0269835 A1* 10/2009 Ceremony et al. ..... B01L 7/52 435/286.2
2012/0017633 A1* 1/2012 Hong et al. ..... A01N 1/0252 62/457.9
2013/0078712 A1* 3/2013 Sano et al. ..... B01L 7/52 435/289.1

FOREIGN PATENT DOCUMENTS

CN 102884169 A 1/2013
CN 106076449 A 11/2016
(Continued)

OTHER PUBLICATIONS

International Search Report of PCT/JP2014/066089.

*Primary Examiner* — Gautam Prakash
(74) *Attorney, Agent, or Firm* — Mattingly & Malur, PC

(57) ABSTRACT

When taking in outside air with a fan to control the temperature inside a covered portion where a specimen is installed, the internal temperature may change depending on an environment temperature to cause a difference in temperature control. The wind generated by the fan may blow against a reaction container depending on its loading position and it may influence the temperature control over individual specimens and lead to problems with temperature accuracy, temperature rise speed, and temperature drop speed. A reaction container avoiding these problems has a covered portion which performs temperature control on the
(Continued)

reaction container and in which a cover and a fin cover have a heat insulating structure. A heat source is provided for controlling an internal temperature of an internal covered space. The internal temperature is kept constant and the influence of the environment temperature over the temperature control of the reaction container is minimized.

23 Claims, 4 Drawing Sheets

(52) U.S. Cl.
CPC ..... *B01L 2300/0654* (2013.01); *B01L 2300/0803* (2013.01); *B01L 2300/1822* (2013.01); *B01L 2300/1844* (2013.01); *B01L 2300/1883* (2013.01)

(58) Field of Classification Search
CPC ..... B01L 2300/046; B01L 2300/0609; B01L 2300/0654; B01L 2300/1844
See application file for complete search history.

(56) References Cited

FOREIGN PATENT DOCUMENTS

| | | | |
|---|---|---|---|
| EP | 2599856 | A1 | 6/2013 |
| JP | 2011-234639 | A | 11/2011 |
| JP | 2011-239688 | A | 12/2011 |
| JP | 2012-228212 | A | 11/2012 |
| WO | 2011/1138925 | A1 | 11/2011 |
| WO | 2013/015057 | A1 | 1/2013 |
| WO | 2014/115863 | A1 | 7/2014 |

* cited by examiner

NUCLEIC ACID AMPLIFICATION/DETECTION DEVICE AND NUCLEIC ACID INSPECTION DEVICE USING SAME

TECHNICAL FIELD

The present invention relates to a nucleic acid amplification/detection apparatus which targets a specimen of biological origin, and a nucleic acid test apparatus using the same.

BACKGROUND ART

The nucleic acid amplification technologies include one using the polymerase chain reaction (Polymerase Chain Reaction; hereinafter referred to as PCR) method. As a known technology related to nucleic acid amplification using such a PCR method, a temperature control apparatus which controls the temperature of a reaction solution obtained by mixing a specimen and a reagent is known.

In the nucleic acid amplification technology based on the PCR method, a reagent and a protocol (conditions on the application of temperature and time) to be used are different depending on the target test item. A batch process method which processes a plurality of reaction solutions under the same test item in one temperature control mechanism at the same time is general until now. However, in recent years, a method which can consecutively process a plurality of different test items in a plurality of temperature control mechanisms has been proposed (see PTL 1).

CITATION LIST

Patent Literature

PTL 1: JP 2011-234639 A

SUMMARY OF INVENTION

Technical Problem

In the PCR method, accurate control of temperature is important. Also in a case of a configuration of processing a plurality of types of specimens under different test items in parallel, it is necessary to perform temperature control on each specimen at uniform temperature accuracy. It needs to be similar temperature accuracy even if the temperature of an environment where the apparatus is installed is different in a certain area.

However, the known technology described in the above PTL 1 is a method for controlling the temperature in a cover 2 covering a portion where a specimen is installed (hereinafter referred to as the internal temperature) by taking in outside air with a fan 9 and the like. Accordingly, the internal temperature changes depending on the environment temperature of a place where the apparatus is installed, which may cause a difference in temperature control between the installed environments. Moreover, the wind generated by the fan 9 may blow against a reaction container 13 in the apparatus depending on its loading position. Accordingly, the degree of the influence of outside air may be different depending on the reaction container 13. Consequently, it may influence temperature control over each specimen and lead to the possibility that temperature performance such as temperature accuracy, a temperature rise speed, and a temperature drop speed cannot be maintained, and the possibility that variations occur in specimens.

The present invention has been made considering the above circumstances, and an object thereof is to provide a nucleic acid amplification/detection apparatus which can maintain stable temperature performance for each of a plurality of reaction containers 13 containing a reaction solution even if an environment temperature of a place where the apparatus is installed is different in a certain area, and minimize variations in temperature, and a nucleic acid test apparatus using the nucleic acid amplification/detection apparatus.

Solution to Problem

The present invention adopts the configurations described in the Claims. For example, with a configuration where a reaction container 13 containing a reaction solution, and a portion which directly or indirectly performs temperature control on the reaction container 13 are covered with a cover 2 and a fin cover 8, which have a heat insulating structure, and further a heat source for controlling the internal temperature of an internal space covered with the cover 2 is included, the internal temperature is kept constant, and the influence of the environment temperature on the temperature control over the reaction container 13 is minimized.

Advantageous Effects of Invention

A nucleic acid amplification/detection apparatus and a nucleic acid test apparatus using the same of the present invention have an advantage that temperature can be controlled maintaining constant temperature accuracy even if an environment temperature changes in a certain area since the temperature control over a reaction container has a little influence of the environment temperature by maintaining the internal temperature constant. Moreover, in a case of a system to be influenced by a change in temperature, a control expression where the influence of external disturbance due to the environment temperature is inserted as a parameter is required to be created for temperature control software. However, according to the present invention, there is an advantage which can handle a change in temperature without the parameter.

DESCRIPTION OF EMBODIMENTS

Modes for carrying out the invention are described hereinafter using the drawings.

First Embodiment

Figure 1:
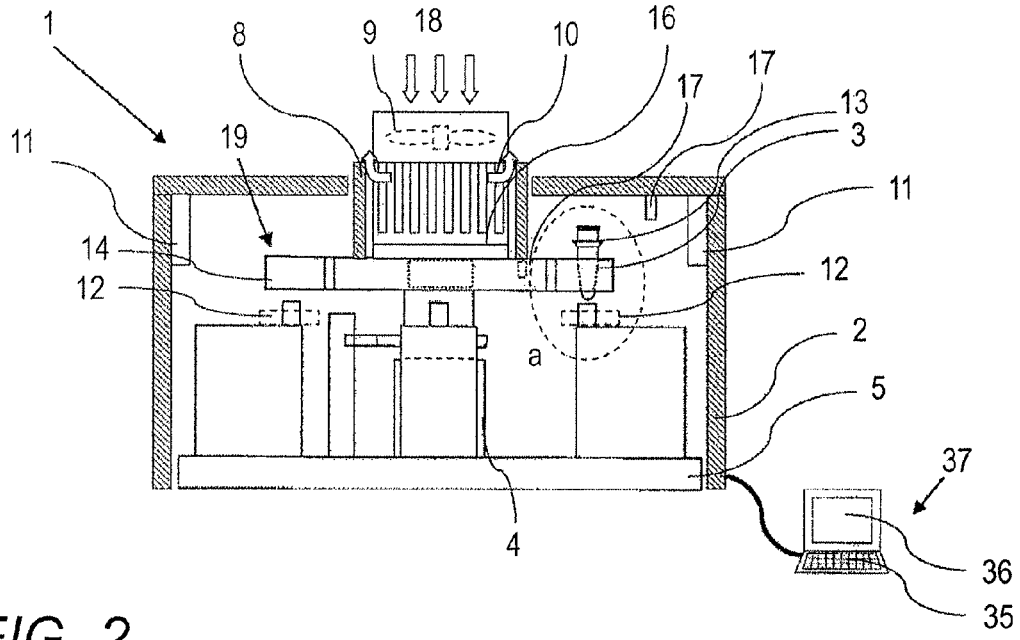
FIG. 1 is an explanatory diagram illustrating a method for carrying out a nucleic acid amplification/detection apparatus. (First Embodiment)
Figure 2:
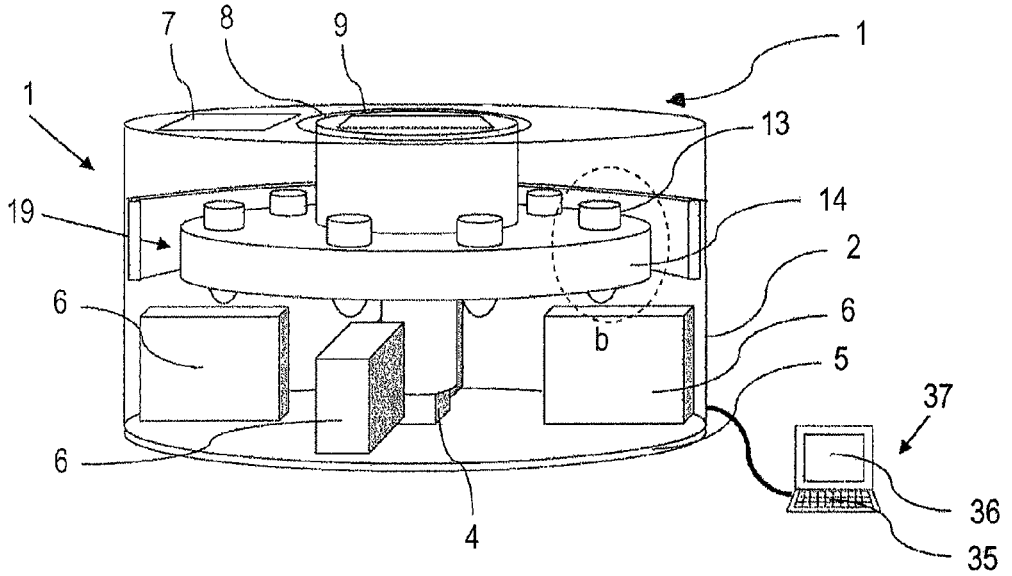
FIG. 2 is a bird's-eye view of the nucleic acid amplification/detection apparatus. (First Embodiment)
Figure 3:
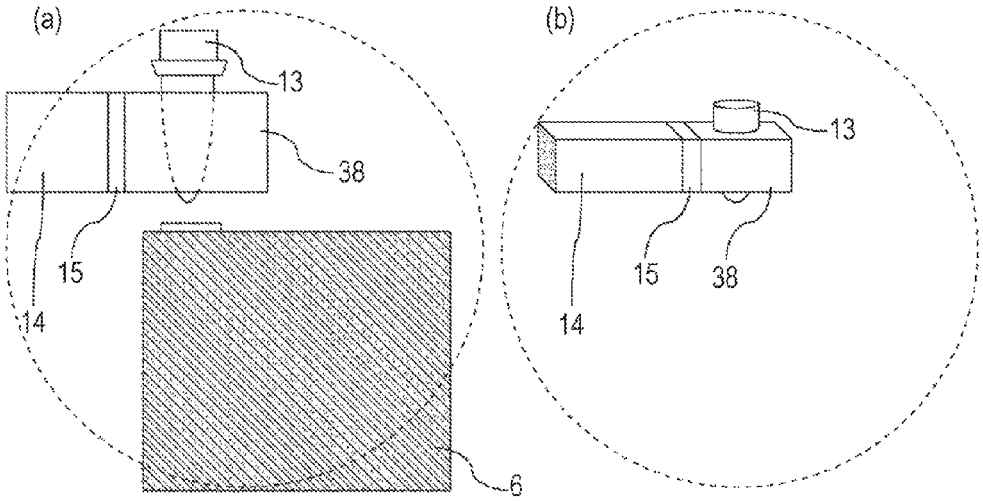
FIG. 3 is a partial enlarged view of portions a and b of FIGS. 1 and 2.

A first embodiment is illustrated in FIGS. 1 to 3. FIG. is a side cross-sectional view of a nucleic acid amplification/detection apparatus 1. FIG. 2 is a bird's-eye view of the nucleic acid amplification/detection apparatus 1. FIG. 3 is a partial enlarged view of portions a and b of FIGS. 1 and 2.

In FIG. 1, the nucleic acid amplification/detection apparatus 1 includes a base 5 serving as a foundation, a holder 19 provided with a plurality of temperature control blocks 38, each having a configuration which holds a reaction container 13, a fluorescence detector 6 which detects fluorescence of a reaction solution contained in the reaction container 13, and a cover 2 which covers the holder 19 and the fluorescence detector 6.

The holder 19 includes a disc-shaped holder base 14 disposed with a central shaft facing upward, and the plurality of temperature control blocks 38 arranged along an inner side of the outer periphery, around the central shaft of the holder base 14. The holder base 14 is provided in such a manner as to be rotatable in the circumferential direction about a rotation shaft provided at the center, and is driven and rotated by a stepping motor 4 being a rotary drive apparatus.

The holder base 14 is formed using a member superior in heat insulating properties such as plastics, and is configured such that the temperatures of the plurality of temperature control blocks 38 hardly interfere with each other. It may be configured such that a heat insulating layer made of a heat insulator such as polyurethane foam is formed between the holder base 14 and the temperature control blocks 38 to further reduce the temperature interference.

The temperature control block 38 includes a basal portion serving as a base of the temperature control block 38, a hole-shaped loading position provided penetrating the basal portion in the up-and-down direction (the up-and-down direction in FIG. 5), a Peltier device 15 as a temperature adjustment device provided in the lower part of the basal portion, and a radiating fin 10, and a temperature sensor 17 which detects temperature near the loading position provided in the basal portion and accordingly detects the temperature of the reaction solution in the reaction container 13. For example, a thermistor, thermocouple, or resistance thermometer is used as the temperature sensor 17.

The basal portion is formed of a thermal conductor such as copper, aluminum, or various alloys. The basal portion is heated or cooled by the Peltier device 15 to adjust the temperature of the reaction container 13 held in the loading position of the basal portion. Moreover, the radiating fin 10 is provided on the other side of the Peltier device 15 from the basal portion to increase the heat dissipation efficiency of the Peltier device 15. The reaction container 13 is inserted in the loading position of the basal portion from above to hold the reaction container 13 with a bottom portion of the reaction container 13 exposed from the temperature control block 38.

In FIG. 2, one or more (for example, four in the embodiment) fluorescence detectors 6 are arranged along the outer periphery of the holder 19 at regular intervals. Moreover, the fluorescence detector 6 is placed below the reaction container 13 (below a traffic line of the reaction container 13) to detect fluorescence when the reaction container 13 passes above it with the rotation of the holder 19. If there is a plurality of the fluorescence detectors 6, they detect or measure the reaction solution in the reaction container 13 independently of each other.

The fluorescence detector 6 includes an excitation light source for applying excitation light to the bottom portion (the exposed portion) of the reaction container 13 held in the loading position of the temperature control block 38, and a detection device for detecting fluorescence from the reaction solution. A base sequence targeted for amplification in the reaction solution contained in the reaction container 13 is fluorescence-labeled with a reagent. The fluorescence detector 6 detects fluorescence from the reaction solution caused by the excitation light applied by the excitation light source to the reaction container 13 to quantify the base sequence targeted for amplification in the reaction solution over time. The obtained detection result is transmitted to a control device 37. For example, a light-emitting diode (LED), semiconductor laser, xenon lamp, or halogen lamp is used as the excitation light source. Moreover, a photodiode, photomultiplier, CCD, or the like is used as the detection device.

The purpose of the cover 2 is a light shielding effect to suppress the incidence of external light upon the fluorescence detector 6 of the nucleic acid amplification/detection apparatus 1 by covering the holder 19 and the fluorescence detector 6 together with the base 5. The cover 2 is provided with an openable gate 7. When the gate 7 is opened, a gripper loads/unloads the reaction container 13 into/from the loading position.

Moreover, the cover 2 has another purpose of suppressing the influence of a change in outside temperature outside the cover on the inside of the cover and keeping the ambient temperature inside the cover constant. Accordingly, the cover 2 is made of a heat insulating material. Alternatively, the cover 2 may be configured to be affixed a heat insulator inside the cover. A heater is installed inside the cover 2 to suppress a change in ambient temperature inside the nucleic acid amplification/detection apparatus 1 covered with the cover 2. The heat source is not limited to a heater, but it may be a Peltier device or system which circulates circulating water such as hot water or cold water. Consequently, the ambient temperature inside the nucleic acid amplification/detection apparatus 1 can be kept constant, and the temperatures of the holder base 14 and the temperature control block 38 can be consecutively changed.

The holder base 14 includes the fin 10, the fan 9, and a Peltier device 16 for secondary cooling to increase heat dissipation efficiency. The fan 9 takes in outside air from the outside of the cover 2 to blow the air to the fin 10. Accordingly, the heat dissipation efficiency of the fin 10 is increased. When the wind past the fin 10 is let into the cover, it influences the ambient temperature inside the cover 2 since the outside air and the amount of heat absorbed by the fin 10 change so that the temperature cannot be controlled. Accordingly, the wind needs to be released to the outside of the cover. Hence, the nucleic acid amplification/detection apparatus 1 includes a fin cover 8. The fin cover 8 may have a structure including a heat insulator.

The fin cover 8 is attached to the holder base 14. Accordingly, a gap is not caused between the fin cover 8 and the holder base 14. Air does not flow into the inside. Consequently, it is possible to prevent both the direct application of the exhaust heat of the fan 9 to the reaction container 13, and a change in internal temperature. As long as it is a structure which can prevent the flowing in of air from a gap between the holder base 14 and the fin cover, the attachment to the holder base 14 is not required. For example, a member which blocks the gap may be further provided, or a duct which guides a wind coming out of the gap to release it to the outside may be provided.

It may be a configuration where instead of the Peltier device 16 for secondary cooling, a heat pipe is mounted in for example, the holder base 14 or the rotation shaft to actively transfer heat from the holder base 14, the rotation shaft or the like to other members. In addition, it is also possible to install a duct and a water-cooling mechanism as appropriate in order to further increase the heat dissipation efficiency. Moreover, FIG. 1 illustrates the mode where the fluorescence detectors 6 are arranged inside the cover 2. However, it may be a system where the fluorescence detectors 6 are installed outside the cover. Their installation place is not limited.

The control device 37 is for controlling the operation of the nucleic acid amplification/detection apparatus 1, performs nucleic acid amplification processes based on protocols set by an input device 35 using various types of software prestored in a storage unit (not illustrated), and stores analysis results such as fluorescence detection results, the moving state of the nucleic acid test apparatus, and the like in the storage unit and displays them on a display device 36.

Second Embodiment

Figure 4:
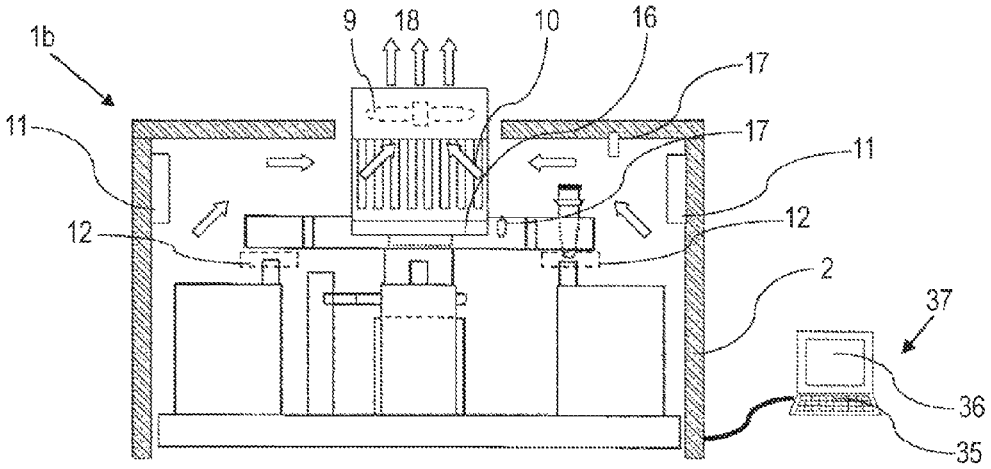
FIG. 4 is an explanatory diagram illustrating a modification of the nucleic acid amplification/detection apparatus. (Second Embodiment)

FIG. 4 illustrates a second embodiment. It is a nucleic acid amplification/detection apparatus obtained by modifying the configuration of the nucleic acid amplification/detection apparatus 1 described in the first embodiment. Portions common to the first embodiment are omitted here, and only differences are described in detail.

The fan 9 for increasing heat dissipation efficiency takes in air inside the cover to release it to the outside of the cover. Upon the release, the air to be released passes the fin to increase the heat dissipation efficiency of the fin 10. In the release by the intake, the air around the reaction container 13 also flows and is sucked out. However, the air inside the cover is controlled by a side heater and a bottom heater at a constant temperature. Accordingly, the influence of a change in temperature on the reaction container is minimized.

In the embodiment, it is possible to control the temperature inside the cover constant without using the fin cover 8.

Third Embodiment

Figure 5:
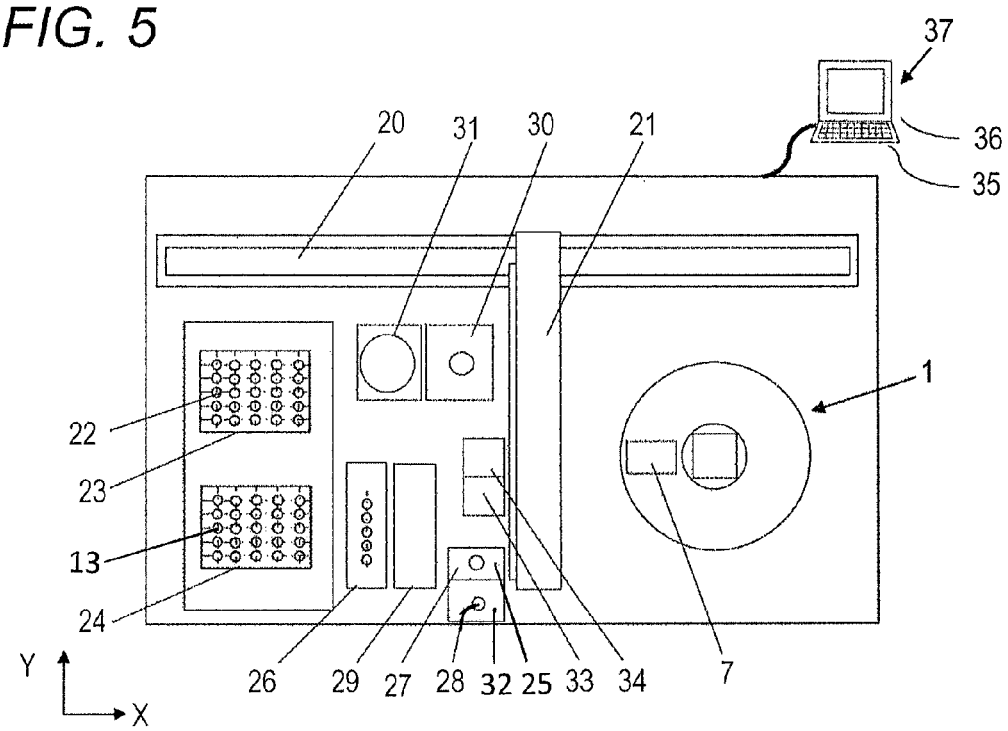
FIG. 5 is an explanatory diagram illustrating a nucleic acid test apparatus equipped with the nucleic acid amplification/detection apparatus. (Third Embodiment)

FIG. 5 illustrates a third embodiment of the present invention. The embodiment is an extended mode as the nucleic acid amplification/detection apparatus described in the first embodiment, or an automatic analysis apparatus which fully automates preprocessing for measurement with the nucleic acid amplification/detection apparatus described in the first embodiment. In FIG. 5, the nucleic acid test apparatus includes a plurality of sample containers 28 which contains a specimen including a nucleic acid targeted for the amplification process, a sample container 28 rack 32 which stores the plurality of sample containers 28, a plurality of reagent containers 25 which contains various reagents to be added to a specimen, a reagent container 25 rack 27 which stores the plurality of reagent containers 25, the reaction containers 13 for mixing a specimen and a reagent, a reaction container rack 24 which stores a plurality of unused reaction containers 13, a reaction solution adjustment position 26 for loading an unused reaction container 13 and dispensing a specimen and a reagent respectively from the sample container 28 and the reagent container 25 into the reaction container 13, a closing unit 30 which seals, with a lid member, the reaction container 13 containing the reaction solution being a mixed solution of the specimen and the reagent, and an agitation unit 31 which agitates the reaction solution contained in the sealed reaction container 13.

Moreover, the nucleic acid test apparatus includes a robot arm apparatus which can move a robot arm X axis 20 extending in an X direction (the left-and-right direction of FIG. 5) and a robot arm Y axis 21 extending in a Y direction (the up-and-down direction of FIG. 5), a gripper unit 33 provided to the robot arm, and a dispensing unit 34 similarly provided to the robot arm. The gripper unit 33 is a mechanism which holds the reaction container 13 and transfers it to each unit in the nucleic acid test apparatus. The dispensing unit 34 is a mechanism which aspirates the specimen of the sample container 28 and the reagent of the reagent container 25, and dispenses them into the reaction container 13 loaded in the reaction solution adjustment position 26. The dispensing unit 34 performs a dispensing operation with a nozzle tip 22 attached to a portion which contacts the specimen and the reagent. At this point in time, the nozzle tip 22 is disposed of after one use. Accordingly, the nucleic acid test apparatus includes a nozzle tip 22 rack 23 which stores a plurality of unused nozzle tips 22, and a waste box (not shown) for discarding a used nozzle tip 22 and a used (tested) reaction container 13.

Furthermore, included are the nucleic acid amplification/detection apparatus 1 which performs the nucleic acid amplification process on the reaction solution contained in the reaction container 13, and the control device 37 which includes the input device 35 such as a keyboard and a mouse and the display device 36 such as a liquid crystal monitor, and controls the entire operation of the nucleic acid test apparatus including the nucleic acid amplification/detection apparatus 1.

Each sample container 28 is managed with identification information such as a barcode according to the contained specimen, and is managed with location information such as coordinates assigned to each location in the sample container 28 rack 32. Similarly, each reagent container 25 is managed with identification information such as a barcode according to the contained reagent, and is managed with location information such as coordinates assigned to each location in the reagent container 25 rack 27. The identification information and the location information is registered in advance in the control device 37 and managed. Moreover, each reaction container 13 is also similarly managed with the identification information and the location information.

Moreover, the nucleic acid test apparatus includes one or two or more nucleic acid amplification/detection apparatuses 1 described in the first embodiment or the nucleic acid amplification/detection apparatuses **1*b* described in the second embodiment. The details of the nucleic acid amplification/detection apparatus 1 and the nucleic acid amplification/detection apparatus 1*b*** have already been describe in the embodiments. Therefore, they are omitted here.

The control device 37 is for controlling the entire operation of the nucleic acid test apparatus, performs the nucleic acid amplification process based on a protocol set by the input device 35 using various types of software prestored in the storage unit (not illustrated), and stores analysis results such as fluorescence detection results, the moving state of the nucleic acid test apparatus, and the like in the storage unit and displays them on the display device 36.

Operations in the embodiment configured as described above are described.

Firstly, as preparation for the nucleic acid amplification process, the sample containers 28 containing a specimen including a nucleic acid targeted for the amplification process are stored in the sample container 28 rack 32 of the nucleic acid test apparatus. The reagent containers 25 containing various reagents to be added to each specimen, which are specified in advance by the protocol, are stored in the reagent container 25 rack 27. Moreover, the unused reaction containers 13 are stored in the reaction container rack 24, and the unused nozzle tips 22 in the nozzle tip 22 rack 23. In this state, the nucleic acid amplification process is started by the operation of the control device 37.

When the start of the nucleic acid amplification process is instructed, the unused reaction containers 13 of the number required are transferred first by the gripper unit 33 to the reaction solution adjustment position 26. Then, the unused nozzle tip 22 is attached to the dispensing unit 34. A specimen is dispensed from a predetermined sample container 28 into the reaction container 13. The used nozzle tip 22 is subsequently discarded into the waste box to prevent contamination. Next, a reagent is also dispensed into the predetermined reaction container 13 in a similar procedure to be mixed with the specimen. Accordingly, a reaction solution is produced.

When dispensing for the required number is finished, the reaction container 13 containing the reaction solution is transferred by the gripper unit 33 to the closing unit 30 to be sealed with the lid member. Further, the reaction container 13 is transferred to the agitation unit 31 to perform the agitation process thereon. The reaction container 13, on which the agitation process has been performed, is transferred by the gripper unit 33 and inserted and held in a loading position at a predetermined position of the holder 19 through the gate 7 of the cover 2 of the agitation/amplification apparatus. At this point in time, the holder 19 is driven and rotated, and controlled to locate the predetermined loading position at the position of the gate 7. If there are a plurality of the reaction containers 13 targeted for the process, they are each sealed with the lid member, and the agitation process is performed on each of them. The reaction containers 13 are sequentially transferred to their predetermined loading positions.

Here, the Peltier device 15 being the temperature adjustment device is controlled based on a protocol corresponding to the specimen contained in the reaction container 13 held by the holder 19. The temperature of the reaction container 13 is cyclically controlled in stages to perform the nucleic acid amplification process. In this manner, in the PCR method being a type of the nucleic acid amplification methods, the temperature of a reaction solution of a mixture of a specimen and a reagent is cyclically changed in stages based on a protocol corresponding to each specimen. Accordingly, a desired base sequence is selectively amplified. Also in a case of processing a plurality of the reaction containers 13 in parallel, if each reaction container 13 is held in the loading position, the nucleic acid amplification process is sequentially started. The temperature is cyclically changed in stages based on a protocol corresponding to each specimen. During the nucleic acid amplification process, the holder 19 is driven to be rotated. The fluorescence detector 6 detects fluorescence. The fluorescence detector 6 detects fluorescence from the reaction solution. Accordingly, the base sequence targeted for amplification in the reaction solution is quantified over time. The detection results are sequentially transmitted to the control device 37.

When the predetermined nucleic acid amplification process ends, the reaction container 13 is transferred by the gripper unit 33 to the waste box through the gate 7 to be discarded.

The effects of the embodiment configured as described above are described.

The nucleic acid detection apparatus of the embodiment minimizes the influence of the temperature of an environment where the apparatus is installed, on a reaction container while fully automating a series of operations from preprocessing to nucleic acid amplification and detection, and accordingly, has a structure than can consecutively and simultaneously analyze a plurality of different test items, and can minimize variations in temperature accuracy in the nucleic acid amplification/detection unit 1 or the nucleic acid amplification/detection unit 1*b*. Moreover, it becomes possible to control temperature accurately with a simpler control expression since there is no need to include an external disturbance factor of the influence of the environment temperature in temperature control software.

Moreover, as structural effects, each temperature control block 38 is detachable from the holder base 14. If any of the plurality of temperature control blocks 38 fails, the failed temperature control block 38 can be easily examined or replaced. Moreover, the reaction containers 13 of different shapes can be simultaneously loaded in the holder base 14 by changing the shape of a loading position 12 provided to a basal portion of the temperature control block 38. Moreover, the basal portion, the temperature adjustment device 14, and the temperature sensor 17 are optimized to support a specific analysis item, and an arbitrary temperature control block 38 can be then mounted on the holder base 14. Consequently, the same holder 19 can deal with various analysis items in a state where the state of the apparatus is optimized for a specified temperature.

The rotation speed (relative rotation speed) of the holder 19 base 14 with respect to the fluorescence detector 6 is controlled to enable the control of the relative speed between the reaction container 13 and the fluorescence detector 6 upon measurement of fluorescence. The relative speed may be a constant speed. Moreover, fluorescence may be detected by a temporary halt at a position where the reaction container 13 faces the fluorescence detector 66.

Fourth Embodiment

Figure 6:
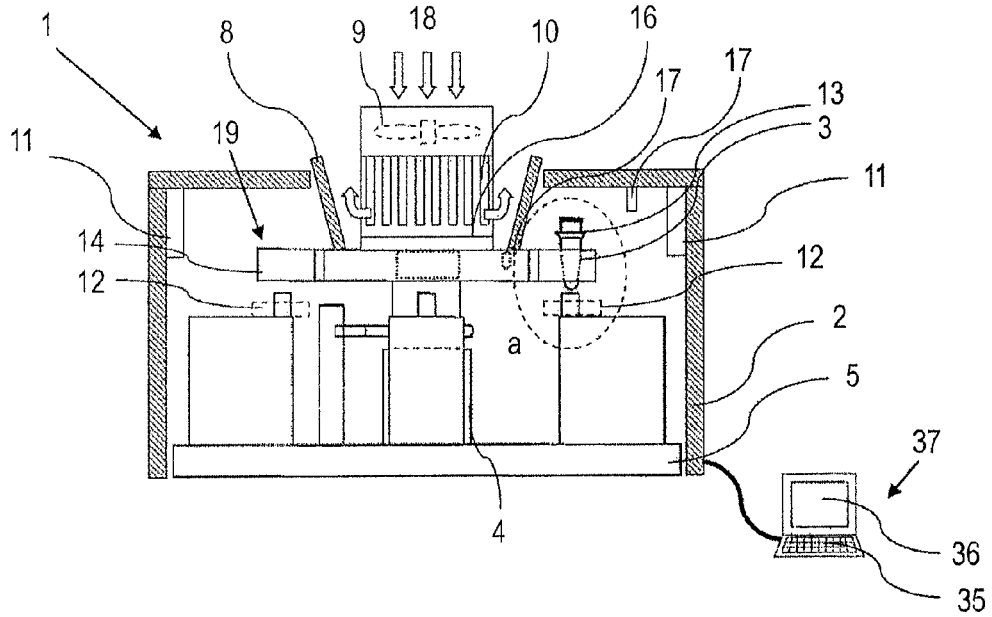
FIG. 6 is an explanatory diagram illustrating a modification of the nucleic acid amplification/detection apparatus. (Fourth Embodiment)

FIG. 6 illustrates a fourth embodiment. It is a nucleic acid amplification/detection apparatus obtained by modifying the configuration of the nucleic acid amplification/detection apparatus 1 described in the first embodiment. Portions common to the first embodiment are omitted here, and only differences are described in detail.

It is a mode where the angle of the attachment of the fin cover 8 is changed to increase the intake/discharge efficiency of the fan 9. For the sake of size reduction of the nucleic acid amplification/detection apparatus 1 and space on the holder base, the fin cover 8 and the fan 9 may have a close positional relationship. As the distance is reduced, the air taken in may not be able to be discharged. Hence, the angle of the attachment of the fin cover 8 is provided in a direction where an upper end of the fin cover 8 is away from the fan 9 to prevent the inhibition of the flow of air.

Fifth Embodiment

Figure 7:
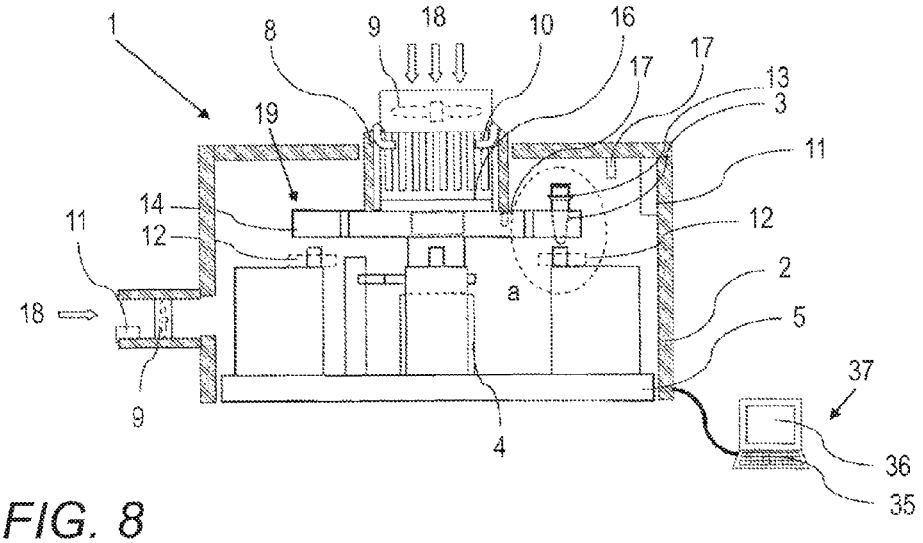
FIG. 7 is an explanatory diagram illustrating a modification of the nucleic acid amplification/detection apparatus. (Fifth Embodiment)

FIG. 7 illustrates a fifth embodiment. It is a nucleic acid amplification/detection apparatus obtained by modifying the configuration of the nucleic acid amplification/detection apparatus 1 described in the first embodiment. Portions common to the first embodiment are omitted here, and only differences are described in detail.

The fifth embodiment is a mode where the heat source installed inside in the first embodiment is now provided outside the cover 2. In this case, the air controlled by an external heater (not specifically shown) at an arbitrary temperature is blown to control the internal temperature at an arbitrary temperature. The external heater is not limited to a heater, but may be a Peltier device or system which circulates circulating water such as hot water or cold water. Moreover, the transfer of heat such as air blowing from the external heater to the inside is performed from one place or a plurality of places. The number of heat transfer places and the like are not limited.

There may be, or may not be, the heat sources such as the side heater 11 and the bottom heater 12 installed inside in the first embodiment.

Sixth Embodiment

Figure 8:
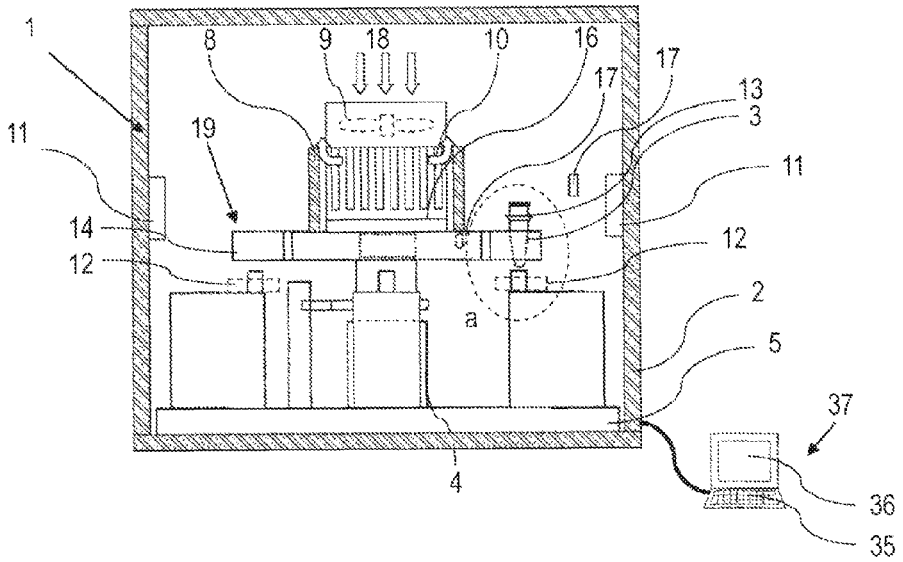
FIG. 8 is an explanatory diagram illustrating a modification of the nucleic acid amplification/detection apparatus. (Sixth Embodiment)

FIG. 8 illustrates a sixth embodiment. It is a nucleic acid amplification/detection apparatus obtained by modifying the configuration of the nucleic acid amplification/detection apparatus 1 described in the first embodiment. Portions common to the first embodiment are omitted here, and only differences are described in detail.

The sixth embodiment is a mode where the cover 2 is upsized and installed in such a manner as to cover the whole nucleic acid amplification/detection apparatus 1. In this mode, the internal temperature is kept constant. Accordingly, the temperature taken in by the fan 9 is stabilized. The Peltier device for secondary cooling can be cooled more efficiently and more stably. In addition, the ambient temperature around the reaction container 13 is also stable. Therefore, the temperature control over the reaction container can be stably performed.

REFERENCE SIGNS LIST

1, 1*b* nucleic acid amplification/detection apparatus
2 cover
3 container loading position
4 stepping motor
5 base
6 fluorescence detector
7 gate
8 fin cover
9 fan
10 fin
11 side heater
12 bottom heater
13 reaction container
14 holder base
15 Peltier device
16 Peltier device for secondary cooling
17 temperature sensor
18 air blowing direction
19 holder
20 robot arm X axis
21 robot arm Y axis
22 nozzle tip
23 nozzle tip rack
24 reaction container rack
25 reagent container
26 reaction solution adjustment position
27 reagent container rack
28 sample container
29 waste box
30 closing unit
31 agitation unit
32 sample container rack
33 gripper unit
34 dispensing unit
35 input device
36 display device
37 control device
38 temperature control block

The invention claimed is:

1. A nucleic acid amplification/detection apparatus which amplifies a nucleic acid of a reaction solution being a mixture of a specimen and a reagent, the nucleic acid amplification/detection apparatus comprising:

a holder having a holder base, the holder being provided with a plurality of temperature control blocks, each temperature control block holding at least one reaction container containing a reaction solution;

a plurality of first temperature adjustment devices provided respectively to the plurality of temperature control blocks to adjust the temperatures of the reaction solutions contained in each of the temperature control blocks;

a cover with a heat insulating structure, which covers the plurality of temperature control blocks and the plurality of temperature adjustment devices provided respectively to the plurality of temperature control blocks;

a second temperature adjustment device provided inside the cover to adjust an ambient temperature inside the cover, the second temperature adjustment device being a side heater attached to a side wall of the cover;

a mechanism supported by the holder base inside the cover, and extending through the cover, to increase heat dissipation from the plurality of temperature adjustment devices and the reaction containers; and a fin cover attached to the holder base inside the cover and between the mechanism which increases heat dissipation from the plurality of temperature adjustment devices and the plurality of reaction containers, the fin cover having an upper end extending through the cover.

2. The nucleic acid amplification/detection apparatus according to claim 1, wherein the fin cover prevents the influence of an environment temperature on the reaction containers, each containing the reaction solution being a mixture of a specimen and a reagent.

3. The nucleic acid amplification/detection apparatus according to claim 1, wherein the reaction containers containing the reaction solution being a mixture of a specimen and a reagent are sequentially loaded in the holder.

4. The nucleic acid amplification/detection apparatus according to claim 1, wherein each reaction container, after a lapse of a predetermined time, is transferred out of the holder at any time.

5. The nucleic acid amplification/detection apparatus according to claim 1, wherein at least any of the temperature control blocks is controllable at a constant temperature during nucleic acid amplification.

6. The nucleic acid amplification/detection apparatus according to claim 1, wherein at least any of the temperature control blocks performs thermal cycling corresponding to PCR amplification.

7. The nucleic acid amplification/detection apparatus according to claim 1, wherein different nucleic acid amplification methods among the temperature control blocks are performed.

8. The nucleic acid amplification/detection apparatus according to claim 1, wherein the reaction containers are placed apart from each other.

9. The nucleic acid amplification/detection apparatus according to claim 1, wherein heat insulation is performed between the reaction containers.

10. The nucleic acid amplification/detection apparatus according to claim 1, wherein the first temperature adjustment device is a Peltier device.

11. The nucleic acid amplification/detection apparatus according to claim 1, wherein each temperature control block is removable from the holder.

12. The nucleic acid amplification/detection apparatus according to claim 1, wherein the holder has the temperature control blocks having different materials and temperature adjustment devices.

13. The nucleic acid amplification/detection apparatus according to claim 1, wherein the cover is provided with a loading portion through which the reaction container is loaded.

14. The nucleic acid amplification/detection apparatus according to claim 1, wherein the holder has a disc shape rotatably provided in a circumferential direction with a central shaft facing upward, and the plurality of first temperature control blocks are arranged in an outer side of and along an outer periphery of the holder.

15. The nucleic acid amplification/detection apparatus according to claim 1, wherein the holder has a ring shape rotatably provided in a circumferential direction with a central shaft facing upward, and the plurality of first temperature control blocks are arranged in one of an inner and outer side of, and along one of an inner and outer periphery of the holder.

16. The nucleic acid amplification/detection apparatus according to claim 1, wherein a loading position of the reaction container is determined, and the holder is rotated up to the predetermined loading position upon the loading of the reaction container.

17. The nucleic acid amplification/detection apparatus according to claim 1, wherein the reaction container is loadable in an arbitrary reaction container installation position of the holder at rest.

18. The nucleic acid amplification/detection apparatus according to claim 1, comprising at least one fluorescence detector which detects fluorescence caused by excitation light applied from a light source to the reaction solution in the reaction container.

19. The nucleic acid amplification/detection apparatus according to claim 18, wherein a plurality of the fluorescence detectors are provided, and each detect fluorescence independently of each other.

20. The nucleic acid amplification/detection apparatus according to claim 1, further comprising a holder temperature control unit which controls a temperature of a portion of the holder excluding the temperature control blocks.

21. The nucleic acid amplification/detection apparatus according to claim 20, wherein the holder temperature control unit is a Peltier device.

22. The nucleic acid amplification/detection apparatus according to claim 1, wherein the mechanism to increase the heat dissipation efficiency of the holder temperature control unit includes a fan.

23. The nucleic acid amplification/detection apparatus according to claim 22, wherein the fin cover is provided such that the upper end thereof is inclined toward a direction away from the fan.

* * * * *